US005178998A

United States Patent [19]

Maskasky et al.

[11] Patent Number: 5,178,998

[45] Date of Patent: Jan. 12, 1993

[54] PROCESS FOR THE PREPARATION OF HIGH CHLORIDE TABULAR GRAIN EMULSIONS (III)

[75] Inventors: Joe E. Maskasky; Yun C. Chang, both of Rochester, N.Y.

[73] Assignee: Eastman Kodak Company, Rochester, N.Y.

[21] Appl. No.: 763,013

[22] Filed: Sep. 20, 1991

[51] Int. Cl.[5] ..... G03C 1/035; G03C 1/07

[52] U.S. Cl. ..... 430/569; 430/567; 430/615

[58] Field of Search ..... 430/615, 614, 600, 569, 430/567

[56] References Cited

U.S. PATENT DOCUMENTS

| | | | |
|---|---|---|---|
| 2,743,181 | 4/1956 | Allen et al. | 430/615 |
| 4,399,215 | 8/1983 | Wey | 430/567 |
| 4,400,463 | 8/1983 | Maskasky | 430/434 |
| 4,414,306 | 11/1983 | Wey | 430/434 |
| 4,713,323 | 12/1987 | Maskasky | 430/569 |
| 4,783,398 | 11/1988 | Takada et al. | 430/567 |
| 4,801,523 | 1/1989 | Tufano | 430/614 |
| 4,804,621 | 2/1989 | Tufano et al. | 430/567 |
| 4,914,016 | 4/1990 | Miyoshi et al. | 430/614 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |

*Primary Examiner*—Charles L. Bowers, Jr.
*Assistant Examiner*—Mark F. Huff
*Attorney, Agent, or Firm*—Carl O. Thomas

[57] ABSTRACT

A process of preparing a radiation sensitive high chloride high aspect ratio tabular grain emulsion is disclosed wherein silver ion is introduced into a gelatino-peptizer dispersing medium containing a stoichiometric excess of chloride ions with respect to the silver ions further characterized by a chloride ion concentration of less than 0.5 molar and a grain growth modifier of the formula:

where $Z^8$ is $—C(R^8)=$ or $—N=$;

$R^8$ is H, $NH_2$ or $CH_3$; and $R^1$ is hydrogen or a hydrocarbon of from 1 to 7 carbon atoms.

17 Claims, 1 Drawing Sheet

3 μm

3 μm

PROCESS FOR THE PREPARATION OF HIGH CHLORIDE TABULAR GRAIN EMULSIONS (III)

FIELD OF THE INVENTION

The invention relates to the precipitation of radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

The various photographic advantages were associated with achieving high aspect ratio tabular grain emulsions. As herein employed and as normally employed in the art, the term "high aspect ratio tabular grain emulsion" has been defined as a photographic emulsion in which tabular grains having a thickness of less than 0.3 μm and an average aspect ratio of greater than 8:1 account for at least 50 percent of the total grain projected area of emulsion. Aspect ratio is the ratio of tabular grain effective circular diameter (ECD), divided by tabular grain thickness (t).

Although the art has succeeded in preparing high chloride tabular grain emulsions, the inclusion of high levels of chloride as opposed to bromide, alone or in combination with iodide, has been difficult. The basic reason is that tabular grains are produced by incorporating parallel twin planes in grains grown under conditions favoring {111} crystal faces. The most prominent feature of tabular grains are their parallel {111} major crystal faces.

To produce successfully a high chloride tabular grain emulsion two obstacles must be overcome. First, conditions must be found that incorporate parallel twin planes into the grains. Second, the strong propensity of silver chloride to produce {100} crystal faces must be overcome by finding conditions that favor the formation of {111} crystal faces.

Wey U.S. Pat. No. 4,399,215 produced the first silver chloride high aspect ratio (ECD/t>8) tabular grain emulsion. An ammoniacal double-jet precipitation technique was employed. The tabularity of the emulsions was not high compared to contemporaneous silver bromide and bromoiodide tabular grain emulsions because the ammonia thickened the tabular grains. A further disadvantage was that significant reductions in tabularity occurred when bromide and/or iodide ions were included in the tabular grains.

Wey et al U.S. Pat. No. 4,414,306 developed a process for preparing silver chlorobromide emulsions containing up to 40 mole percent chloride based on total silver. This process of preparation has not been successfully extended to high chloride emulsions.

Maskasky U.S. Pat. No. 4,400,463 (hereinafter designated Maskasky I) developed a strategy for preparing a high chloride, high aspect ratio tabular grain emulsion capable of tolerating significant inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers. The principal disadvantage of this approach has been the necessity of employing a synthetic peptizer as opposed to the gelatino-peptizers almost universally employed in photographic emulsions.

This work has stimulated further investigations of grain growth modifiers for preparing tabular grain high chloride emulsions, as illustrated by Takada et al U.S. Pat. No. 4,783,398, which employs heterocycles containing a divalent sulfur ring atom; Nishikawa et al U.S. Pat. No. 4,952,491, which employs spectral sensitizing dyes and divalent sulfur atom containing heterocycles and acyclic compounds; and Ishiguro et al U.S. Pat. No. 4,983,508, which employs organic bis-quaternary amine salts.

Maskasky U.S. Pat. No. 4,713,323 (hereinafter designated Maskasky II), continuing to use aminoazaindene growth modifiers, particularly adenine, discovered that tabular grain high chloride emulsions could be prepared by running silver salt into a dispersing medium containing at least a 0.5 molar concentration of chloride ion and an oxidized gelatino-peptizer. An oxidized gelatino-peptizer is a gelatino-peptizer treated with a strong oxidizing agent to modify by oxidation (and eliminate or reduce as such) the methionine content of the peptizer. Maskasky II taught to reduce the methionine content of the peptizer to a level of less than 30 micromoles per gram. King et al U.S. Pat. No. 4,942,120 is essentially cumulative, differing only in that methionine was modified by alkylation.

While Maskasky II overcame the synthetic peptizer disadvantage of Maskasky I, the requirement of a chloride ion concentration of at least 0.5 molar in the dispersing medium during precipitation presents disadvantages. At the elevated temperatures typically employed for emulsion precipitations using gelatino-peptizers, the high chloride ion concentrations corrode the stainless steel vessels used for the preparation of photographic emulsions. Additionally, the high chloride ion concentrations increase the amount of emulsion washing required after precipitation, and disposal of the increased levels of chloride ion represents increased consumption of materials and an increased ecological burden.

Tufano et al U.S. Pat. No. 4,804,621 disclosed a process for preparing high aspect ratio tabular grain high chloride emulsions in a gelatino-peptizer. Tufano et al taught that over a wide range of chloride ion concentrations ranging from pCl 0 to 3 (1 to $1\times10^{-3}$ M) 4,6-diaminopyrimidines satisfying specific structural requirements were effective growth modifiers for producing high chloride tabular grain emulsions. Tufano et al specifically required that the following structural formula be satisfied:

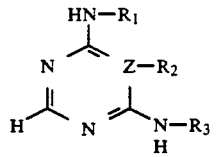

wherein Z is C or N; $R_1$, $R_2$ and $R_3$, which may be the same or different, are H or alkyl of 1 to 5 carbon atoms; Z is C, $R_2$ and $R_3$ when taken together can be $—CR_4=CR_5—$ or $—CR_4=N—$, wherein $R_4$ and $R_5$, which may be the same or different are H or alkyl of 1 to 5 carbon atoms, with the proviso that when $R_2$ and $R_3$ taken together form the $—CR_4=N—$ linkage, $—CR_4=$ must be joined to Z. Tufano et al also contemplated salts of the formula compound. Tufano et al demonstrated the failure of adenine as a growth modifier. Thus, Tufano et al discourages the selection of heterocycles for use as grain growth modifiers that lack two primary or secondary amino ring substituents in the indicated relationship to the pyrimidine ring nitrogen atoms and those compounds that contain a nitrogen atom linked to the 5-position of the pyrimidine ring.

RELATED PATENT APPLICATIONS

Maskasky U.S. Ser. No. 763,382, concurrently filed, now abandoned, and commonly assigned, titled IMPROVED PROCESS FOR THE PREPARATION OF HIGH CHLORIDE TABULAR GRAIN EMULSIONS (I), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar, a pH of at least 4.5, and a 4,6-di(hydroamino)-5-aminopyrimidine grain growth modifier.

Maskasky U.S. Ser. No. 762,971, concurrently filed and commonly assigned, titled IMPROVED PROCESS FOR THE PREPARATION OF HIGH CHLORIDE TABULAR GRAIN EMULSIONS (II), (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

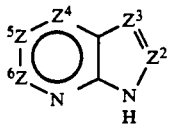

where $Z^2$ is $—C(R^2)=$ or $—N=$;
$Z^3$ is $—C(R^3)=$ or $—N=$;
$Z^4$ is $—C(R^4)=$ or $—N=$;
$Z^5$ is $—C(R^5)=$ or $—N=$;
$Z^6$ is $—C(R^6)=$ or $—N=$;

with the proviso that no more than one of $Z^4$, $Z^5$ and $Z^6$ is $—N=$;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 763,030, concurrently filed and commonly assigned, titled ULTRATHIN HIGH CHLORIDE TABULAR GRAIN EMULSIONS, (hereinafter designated Maskasky V) discloses a high chloride tabular grain emulsion in which greater than 50 percent of the total grain projected area is accounted for by ultrathin tabular grains having a thickness of less than 360 {111} crystal lattice planes. A {111} crystal face stabilizer is adsorbed to the major faces of the ultrathin tabular grains.

SUMMARY OF THE INVENTION

In one aspect, this invention is directed to a process of preparing a radiation sensitive high aspect ratio tabular grain emulsion, wherein tabular grains of less than 0.3 μm in thickness and an average aspect ratio of greater than 8:1 account for greater than 50 percent of the total grain projected area, the tabular grains containing at least 50 mole percent chloride, based on silver, comprising introducing silver ion into a gelatino-peptizer dispersing medium containing a stoichiometric excess of chloride ions a chloride ion concentration of less than 0.5 molar and a grain growth modifier of the formula:

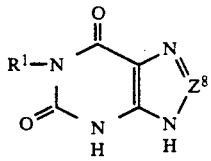

where $Z^8$ is $—C(R^8)=$ or $—N=$;
$R_8$ is H, $NH_2$ or $CH_3$; and
$R^1$ is hydrogen or a hydrocarbon containing from 1 to 7 carbon atoms.

It has been discovered quite unexpectedly that a novel class of grain growth modifiers are capable of producing high chloride tabular grain emulsions at unexpectedly low stoichiometric levels of excess chloride ion. The lowered stoichiometric excess of chloride ion avoids the corrosion, increased washing, materials consumption and ecological burden concerns inherent in the Maskasky II process. The disadvantage of Maskasky I of requiring a synthetic peptizer is also avoided. At the same time, xanthines and 8-azaxanthines, a whole new class of grain growth modifiers are recognized to be useful. Thus, the process of the invention provides a practical and attractive preparation of high chloride tabular grain emulsions.

BRIEF DESCRIPTION OF THE DRAWINGS

In FIG. 1 the emulsion is viewed perpendicular to the support, and in FIG. 2 the emulsion is viewed at a declination of 60° from the perpendicular and at high level of magnification.

DESCRIPTION OF THE PREFERRED EMBODIMENTS

Figure 1:
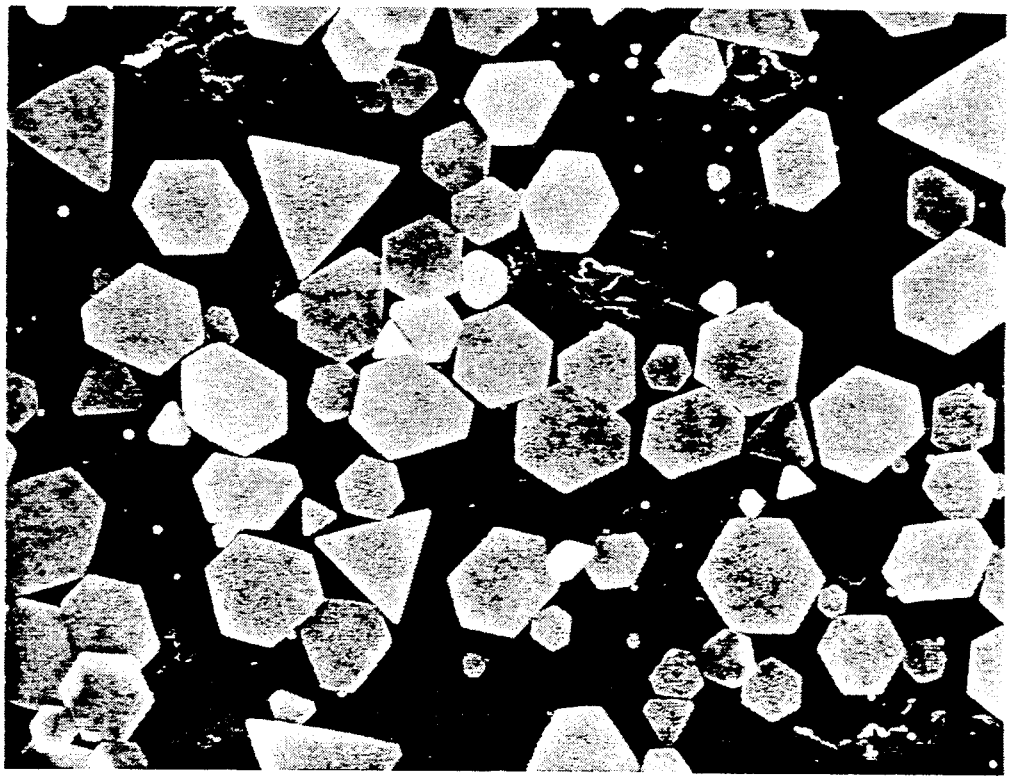
FIGS. 1 and 2 are scanning electron photomicrographs of an emulsion prepared according to the invention.

In preferred embodiments the processes of preparing high chloride high aspect ratio tabular grain emulsions of this invention employ a novel class of grain growth modifiers satisfying the formula:

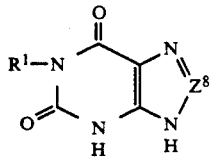

(I)

where $Z^8$ is $-C(R^8)=$ or $-N=$;

$R^8$ is H, $NH_2$ or $CH_3$; and $R^1$ is hydrogen or a hydrocarbon of from 1 to 7 carbon atoms.

The grain growth modifiers of formula I are hereinafter referred to generically as xanthine and 8-azaxanthine grain growth modifiers.

When the grain growth modifier is chosen to have a xanthine nucleus, the structure of the grain growth modifier is as shown in the following formula:

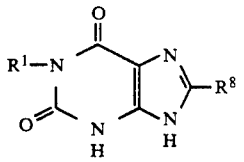

(II)

When the grain growth modifier is chosen to have an 8azaxanthine nucleus, the structure of the grain growth modifier is as shown in the following formula:

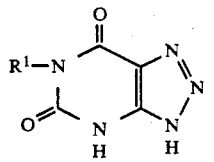

(III)

No substituents of any type are required on the ring structures of formulae I to III. Thus, each of $R^1$ and $R^8$ can in each occurrence be hydrogen. $R^8$ can in addition include a sterically compact hydrocarbon substituent, such as $CH_3$ or $NH_2$. $R^1$ can additionally include a hydrocarbon substituent of from 1 to 7 carbon atoms. Each hydrocarbon moiety is preferably an alkyl group--e.g., methyl, ethyl, n-propyl, i-propyl, n-butyl, i-butyl, t-butyl, etc. , although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

An aqueous gelatino-peptizer dispersing medium is present during precipitation. Gelatinopeptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatinopeptizers with all naturally occurring methionine levels are useful. It is, of course, possible, though not required, to reduce or eliminate methionine, as taught by Maskasky II or King et al, both cited above and here incorporated by reference.

During the precipitation of photographic silver halide emulsions there is always a slight stoichiometric excess of halide ion present. This avoids the possibility of excess silver ion being reduced to metallic silver and resulting in photographic fog. It is a significant advantage of this invention that the stoichiometric excess of chloride ion in the dispersing medium can be maintained at a chloride concentration of less than 0.5 M while still obtaining a high aspect ratio tabular grain emulsion. It is generally preferred that the chloride ion concentration in the dispersing medium be less than 0.2 M and, optimally, equal to or less than 0.1 M.

The advantages of limiting the stoichiometric excess of chloride ion present in the reaction vessel during precipitation include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent. It has also been observed that reduction in the chloride ion excess contributes to obtaining thinner tabular grains.

The grain growth modifiers of the invention are effective over a wide range of pH levels conventionally employed during the precipitation of silver halide emulsions. It is contemplated to maintain the dispersing medium within conventional pH ranges for silver halide precipitation, typically from 3 to 9, while the tabular grains are being formed, with a pH range of 4.5 to 8 being in most instances preferred. Within these pH ranges optimum performance of individual grain growth modifiers can be observed as a function of their specific structure. A strong mineral acid, such as nitric acid or sulfuric acid, or a strong mineral base, such as an alkali hydroxide, can be employed to adjust pH within a selected range. When a basic pH is to be maintained, it is preferred not to employ ammonium hydroxide, since it has the unwanted effect of acting as a ripening agent and is known to thicken tabular grains. However, to the extent that thickening of the tabular grains does not exceed the 0.3 μm thickness limit, ammonium hydroxide or other conventional ripening agents (e.g., thioether or thiocyanate ripening agents) can be present within the dispersing medium.

Any convenient conventional approach of monitoring and maintaining replicable pH profiles during repeated precipitations can be employed (e.g., refer to Research Disclosure Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxymethyl)aminomethane.

In forming high chloride high aspect ratio tabular grain emulsions, tabular grains containing at least 50 mole percent chloride, based on silver, and having a thickness of less than 0.3 μm must account for greater than 50 percent of the total grain projected area. In preferred emulsions the tabular grains having a thickness of less than 0.2 μm account for at least 70 percent of the total grain projected area.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major {111} crystal faces of the tabular grains, since this has the effect of thickening the grains. The grain growth modifiers employed in the practice of this invention are effective during precipitation to produce an emulsion satisfying both the tabular grain thickness and projected area parameters noted above.

It is believed that the effectiveness of the grain growth modifiers to induce twinning during precipitation results from the spacing of the required nitrogen atoms in the fused five and six membered heterocyclic rings and their ability to form silver salts. This can be better appreciated by reference to the following structure:

(IV)

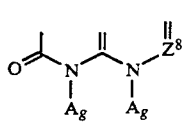

C. Cagnon et al, Inorganic Chem., 16:2469 (1977) reports a silver salt satisfying the nitrogen atom and silver pairing arrangement of formula IV and provides bond lengths establishing the spacing between the adjacent silver atoms of the formula. Based on the crystal structure of silver chloride revealed by X-ray diffraction it is believed that the resulting spacing between the silver ions is much closer to the nearest permissible spacing of silver ions in next adjacent {111} silver ion crystal lattice planes separated by a twin plane than the nearest spacing of silver ions in next adjacent {111} silver ion crystal lattice planes not separated by a twin plane. Thus, when one of the silver ions shown above is positioned during precipitation in a {111} silver ion crystal lattice plane, assuming a sterically compatible location (e.g., an edge, pit or coign position) is occupied, the remaining of the silver ions shown above favors a position in the next {111} silver ion crystal lattice plane that is permitted only if twinning occurs. The remaining silver atom of the growth modifier (together with other similarly situated growth modifier silver ions) acts to seed (enhance the probability of) a twin plane being formed and growing across the {111} crystal lattice face, thereby providing a permanent crystal feature essential for tabular grain formation.

It is, of course, also important that the ring substituents next adjacent the ring nitrogen shown in formula IV be chosen to minimize any steric hindrance that would prevent the silver ions from having ready access to the {111} crystal lattice planes as they are being formed. A further consideration is to avoid substituents to the ring positions next adjacent the ring nitrogen shown that are strongly electron withdrawing, since this creates competition between the silver ions and the adjacent ring position for the π electrons of the nitrogen atoms. When $Z^8$ is —N= or —CH=, an optimum structure for silver ion placement in the crystal lattice exists. When $Z^8$ is —C($R^8$)= and $R^8$ is a compact substituent, as described above, twin plane formation is readily realized. In formula IV the ring positions separated from the ring nitrogen by an intervening ring position are not shown, these ring positions and their substituents are not viewed as significantly influencing twin plane formation.

In addition to selecting substituents for their role in twin plane formation, they must also be selected for their compatibility with promoting the formation of {111} crystal faces during precipitation. By selecting substituents as described above the emergence of {100}, {110} and higher index crystal plane faces of the types described by Maskasky U.S. Pat. Nos. 4,643,966, 4,680,254, 4,680,255, 4,680,256 and 4,724,200, is avoided. In those instances in which a second grain growth modifier is relied upon to assure emergence of {111} crystal faces during precipitation, a broadened selection of substituents not affecting twin plane formation is specifically contemplated.

It is generally recognized that introducing twin planes in the grains at a very early stage in their formation offers the capability of producing thinner tabular grains than can be achieved when twinning is delayed. For this reason it is usually preferred that the conditions within the dispersing medium prior to silver ion introduction at the outset of precipitation be chosen to favor twin plane formation. To facilitate twin plane formation it is contemplated to incorporate the grain growth modifier in the dispersing medium prior to silver ion addition in a concentration of at least $2\times10^{-4}$ M, preferably at least $5\times10^{-4}$ M, and optimally at least $7\times10^{-4}$ M. Generally little increase in twinning can be attributed to increasing the initial grain growth modifier concentration in the dispersing medium above 0.01 M. Higher initial grain growth modifier concentrations up to 0.05 M, 0.1 M or higher are not incompatible with the twinning function. The maximum growth modifier concentration in the dispersing medium is often limited by its solubility. It is contemplated to introduce into the dispersing medium growth modifier in excess of that which can be initially dissolved. Any undissolved growth modifier can provide a source of additional growth modifier solute during precipitation, thereby stabilizing growth modifier concentrations within the ranges noted above. It is preferred to avoid quantities of grain growth modifier in excess of those observed to control favorably tabular grain parameters.

Once a stable multiply twinned grain population has been formed within the dispersing medium, the primary, if not exclusive, function the grain growth modifier is called upon to perform is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of grain growth modifier required to control thickness growth of the tabular grain population is a function of the total grain surface area. By adsorption onto the {111} surfaces of the tabular grains the grain growth modifier restrains precipitation onto the grain faces and shifts further growth of the tabular grains to their edges.

The benefits of this invention can be realized using any amount of grain growth modifier that is effective to retard thickness growth of the tabular grains. It is generally contemplated to have present in the emulsion during tabular grain growth sufficient grain growth modifier to provide a monomolecular adsorbed layer over at least 25 percent, preferably at least 50 percent, of the total {111} grain surface area of the emulsion grains. Higher amounts of adsorbed grain growth modifier are, of course, feasible Adsorbed grain growth modifier coverages of 80 percent of monomolecular layer coverage or even 100 percent are contemplated. In terms of tabular grain thickness control there is no significant advantage to be gained by increasing grain growth modifier coverages above these levels. Any excess grain growth modifier that remains unadsorbed is normally depleted in post-precipitation emulsion washing.

Prior to introducing silver salt into the dispersing medium at the outset of the precipitation process, no grains are present in the dispersing medium, and the initial grain growth modifier concentrations in the dispersing medium are therefore more than adequate to provide the monomolecular coverage levels noted above as grains are initially formed. As tabular grain growth progresses it is a simple matter to add grain growth modifier, as needed, to maintain monomolecular coverages at desired levels, based on knowledge of amount of silver ion added and the geometrical forms of the grains being grown. If, as noted above, grain growth modifier has been initially added in excess of its solubility limit, undissolved grain growth modifier can enter solution as dissolved grain growth modifier is depleted from the dispersing medium by adsorption on grain surfaces. This can reduce or even eliminate any need to add grain growth modifier to the reaction vessel as grain growth progresses.

The grain growth modifiers described above are capable of use during precipitation as the sole grain growth modifier. That is, these grain growth modifiers are capable of influencing both twinning and tabular grain growth to provide high chloride high aspect ratio tabular grain emulsions.

It has been discovered that improvements in precipitation can be realized by employing a combination of grain growth modifiers in which the more tightly adsorbed of the grain growth modifiers is employed for tabular grain thickness growth reduction while the less tightly adsorbed of the grain growth modifiers is employed for twinning. Different grain growth modifiers of this invention can be employed in combination on this basis, with the less tightly adsorbed grain growth modifier being employed during grain twinning and the more tightly adsorbed grain growth modifier being present during grain growth following twinning.

Instead of employing a grain growth modifier of this invention to perform each of the twinning and tabular grain thickness control functions, it is possible to employ another growth modifier to perform one of these two functions.

It is specifically contemplated to employ during twinning or grain growth a grain growth modifier of the following structure:

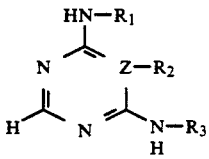

(V)

wherein Z is C or N; $R_1$, $R_2$ and $R_3$, which may be the same or different, are H or alkyl of 1 to 5 carbon atoms; Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together form the $—CR_4{=}N—$ linkage, $—CR_4{=}$ must be joined to Z. Grain growth modifiers of this type and conditions for their use are disclosed by Tufano et al, cited above, the disclosure of which is here incorporated by reference.

It is also contemplated to employ during grain twinning or grain growth following twinning a grain growth modifier of the type disclosed by Maskasky III, cited above. These grain growth modifiers are effective when the dispersing medium is maintained at a pH in the range of from 4.6 to 9 (preferably 5.0 to 8) and contains a stoichiometric excess of chloride ions of less than 0.5 molar. These grain growth modifiers are 4,6-di(hydroamino)-5-aminopyrimidine grain growth modifiers, with preferred compounds satisfying the formula:

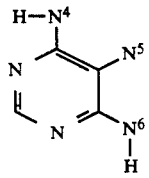

(VI)

where $N^4$, $N^5$ and $N^6$ are amino moieties independently containing hydrogen or hydrocarbon substituents of from 1 to 7 carbon atoms, with the proviso that the $N^5$ amino moiety can share with each or either of $N^4$ and $N^6$ a common hydrocarbon substituent completing a five or six member heterocyclic ring. The grain growth modifiers of this formula when present during grain twinning are capable of producing ultrathin tabular grain emulsions.

It is also contemplated to employ during grain twinning or growth a grain growth modifier of the type disclosed by Maskasky IV, cited above. These grain growth modifiers are effective when the dispersing medium is maintained at a pH in the range of from 3 to 9 (preferably 4.5 to 8) and contains a stoichiometric excess of chloride ions of less than 0.5 molar. These grain growth modifiers satisfy the formula:

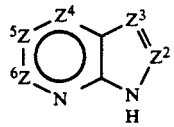

(VII)

where $Z^2$ is $—C(R^2){=}$ or $N{=}$;
$Z^3$ is $—C(R^3){=}$ or $—N{=}$;
$Z^4$ is $—C(R^4){=}$ or $—N{=}$;
$Z^5$ is $—C(R^5){=}$ or $—N{=}$;
$Z^6$ is $—C(R^6){=}$ or $—N{=}$;

with the proviso that no more than one of $Z^4$, $Z^5$ *and* $Z^6$ is $—N{=}$;

$R^2$ is H, $NH_2$ or $CH_3$;

$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and $R^6$ is H or $NH_2$.

Still another type of grain growth modifier contemplated for use during grain growth is iodide ion. The use of iodide ion as a grain growth modifier is taught by Maskasky I, the disclosure of which is here incorporated by reference.

In Maskasky U.S. Ser. No. 623,839, filed Dec. 7, 1990, AN IMPROVED PROCESS FOR THE PREPARATION OF HIGH CHLORIDE TABULAR GRAIN EMULSIONS, commonly assigned, (hereinafter referred to as Maskasky VII) it is taught to maintain a concentration of thiocyanate ions in the dispersing medium of from 0.2 to 10 mole, based on total silver introduced, to produce a high chloride tabular grain emulsion. It is here contemplated to utilize thiocyanate ion in a similar manner to control tabular grain growth. However, whereas Maskasky VII employs a 0.5 M concentration of chloride ion in the dispersing medium, the presence of the xanthine or azaxanthine grain growth modifier in the dispersing medium at the outset of precipitation allows lower chloride ion levels to be present in the dispersing medium, as described above. The thiocyanate ion can be introduced into the dispersing medium as any convenient soluble salt, typically an alkali or alkaline earth thiocyanate salt. When the dispersing medium is acidic (i.e., the pH is less than 7.0) the counter ion of the thiocyanate salt can be ammonium ion, since ammonium ion releases an ammonia ripening agent only under alkaline conditions. Although not preferred, an ammonium counter ion is not precluded under alkaline conditions, since, as noted above, ripening can be tolerated to the extent that the 0.3 μm thickness limit of the tabular grains is not exceeded.

In addition to or in place of the preferred growth modifiers for use in combination with any of the growth modifiers of this invention it is contemplated to employ other conventional growth modifiers, such any of those disclosed by Takada et al, Nishikawa et al, and Ishiguro et al, cited above and here incorporated by reference.

Since silver bromide and silver iodide are markedly less soluble than silver chloride, it is appreciated that bromide and/or iodide ions, if introduced into the dispersing medium, are incorporated into the grains in the presence to the chloride ions. The inclusion of bromide ions in even small amounts has been observed to improve the tabularities of the emulsions. Bromide ion concentrations of up to 50 mole percent, based on total silver are contemplated, but to increase the advantages of high chloride concentrations it is preferred to limit the presence of other halides so that chloride accounts for at least 80 mole percent, based on silver, of the completed emulsion. Iodide can be also incorporated into the grains as they are being formed. It is preferred to limit iodide concentrations to 2 mole percent or less based on total silver. Thus, the process of the invention is capable of producing high chloride tabular grain emulsions in which the tabular grains consist essentially of silver chloride, silver bromochloride, silver iodochloride or silver iodobromochloride, where the halides are designated in order of ascending concentrations.

Either single-jet or double-jet precipitation techniques can be employed in the practice of the invention, although the latter is preferred. Grain nucleation can occur before or instantaneously following the addition of silver ion to the dispersing medium. While sustained or periodic subsequent nucleation is possible, to avoid polydispersity and reduction of tabularity, once a stable grain population has been produced in the reaction vessel, it is preferred to precipitate additional silver halide onto the existing grain population.

In one approach silver ion is first introduced into the dispersing medium as an aqueous solution, such as a silver nitrate solution, resulting in instantaneous grain nuclei formation followed immediately by addition of the growth modifier to induce twinning and tabular grain growth. Another approach is to introduce silver ion into the dispersing medium as preformed seed grains, typically as a Lippmann emulsion having an ECD of less than 0.05 μm. A small fraction of the Lippmann grains serve as deposition sites while the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048, the disclosures of which are here incorporated by reference. In still another approach, immediately following silver halide seed grain formation within or introduction into a reaction vessel, a separate step is provided to allow the initially formed grain nuclei to ripen in the presence of a grain growth modifier. During the ripening step the proportion of untwinned grains can be reduced, thereby increasing the tabular grain content of the final emulsion. Also, the thickness and diameter dispersities of the final tabular grain population can be reduced by the ripening step. Ripening can be performed by stopping the flow of reactants while maintaining initial conditions within the reaction vessel or increasing the ripening rate by adjusting pH, the chloride ion concentration, and/or increasing the temperature of the dispersing medium. The pH, chloride ion concentration and grain growth modifier selections described above for precipitation can be first satisfied from the outset of silver ion precipitation or during the ripening step.

Except for the distinguishing features discussed above, precipitation according to the invention can take any convenient conventional form, such as disclosed in Research Disclosure Vol. 225, January, 1983, Item 22534; Research Disclosure Vol. 308, December, 1989, Item 308,119 (particularly Section I); Maskasky I, cited above; Wey et al, cited above; and Maskasky II, cited above; the disclosures of which are here incorporated by reference. It is typical practice to incorporate from about 20 to 80 percent of the total dispersing medium into the reaction vessel prior to nucleation. At the very outset of nucleation a peptizer is not essential, but it is usually most convenient and practical to place peptizer in the reaction vessel prior to nucleation. Peptizer concentrations of from about 0.2 to 10 (preferably 0.2 to 6) percent, based on the total weight of the contents of the reaction vessel are typical, with additional peptizer and other vehicles typically be added to emulsions after they are prepared to facilitate coating.

Once the nucleation and growth steps have been performed the emulsions can be applied to photographic applications following conventional practices. The emulsions can be used as formed or further modified or blended to satisfy particular photographic aims. It is possible, for example, to practice the process of this invention and then to continue grain growth under conditions that degrade the tabularity of the grains and/or alter their halide content. It is also common practice to blend emulsions once formed with emulsions having differing grain compositions, grain shapes and/or tabular grain thicknesses and/or aspect ratios.

EXAMPLES

The invention can be better appreciated by reference to the following examples.

The mean thickness of tabular grain populations was measured by optical interference for mean thicknesses >0.06 μm measuring more than 1000 tabular grains.

The terms ECD and t are employed as noted above; r.v. represents reaction vessel; GGM is the acronym for grain growth modifier; TGPA indicates the percentage of the total grain projected area accounted by tabular grain of less than 0.3 μm thickness.

EXAMPLE 1

AgCl High Aspect Ratio Tabular Grain Emulsions Precipitated at pH 6.2

Figure 2:
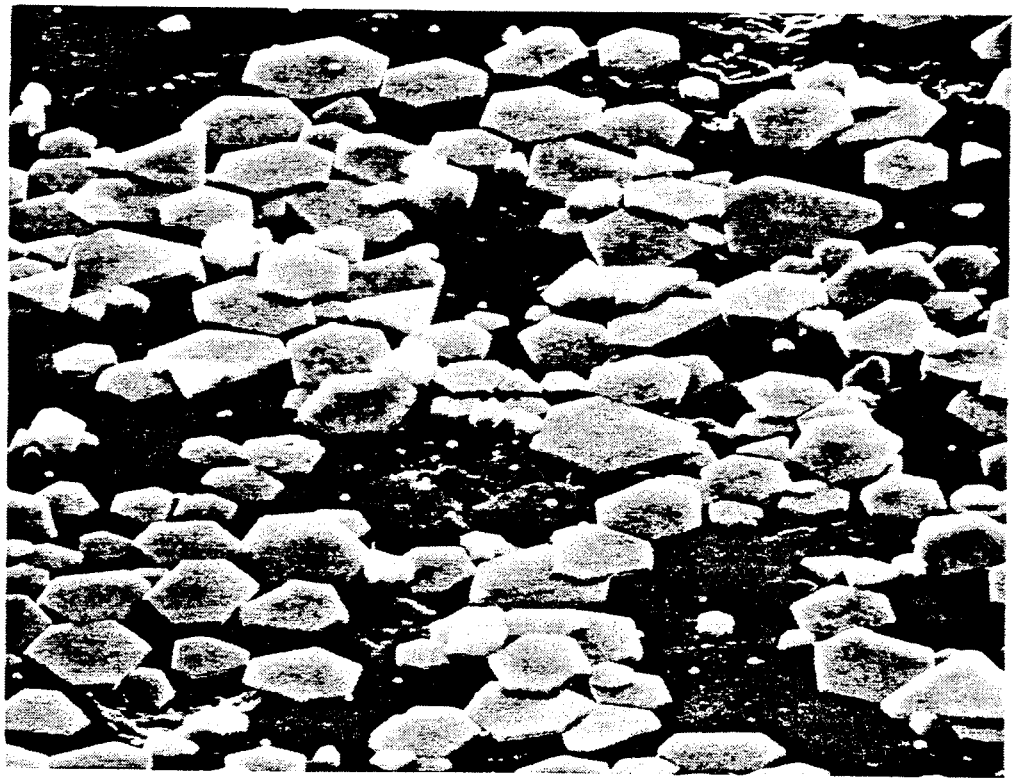

To a stirred reaction vessel containing 300 mL of a solution at 75° C. that was 2.7% in bone gelatin, 0.053 M in NaCl, and 2.7 M in sodium acetate was added 100 mL of 12 mM basic xanthine solution. The pH of the resulting solution was adjusted to 6.2. A 4M $AgNO_3$ solution and a 4M NaCl solution were added. The $AgNO_3$ solution was added at 0.25 mL/min for 4 min then its flow was stopped for 15 minutes then resumed at 0.25 mL/min for 2 min. The flow rate was then accelerated over an additional period of 30 min (20 X from start to finish) and finally held constant at 5 mL/min until 0.4 mole of $AgNO_3$ was added. The NaCl solution was added at a similar rate as needed to maintain a constant pAg of 6.65. When the pH dropped 0.2 units below the starting value of 6.2, the flow of solutions was momentarily stopped and the pH was adjusted back to the starting value. The results are shown in Table I and in FIGS. 1 and 2.

EXAMPLE 1B

This emulsion was prepared similar to that of Example 1A, except that the precipitation was stopped after 0.27 mole of $AgNO_3$ had been added. The results are given in Table I.

EXAMPLE 1C

This emulsion was prepared similar to that of Example 1, except that the precipitation was stopped after 0.13 mole of $AgNO_3$ had been added. The results are given in Table I.

EXAMPLE 2

AgCl High Aspect Ratio Tabular Grain Emulsions Precipitated at pH 7.0

A reaction vessel, equipped with a stirrer, was charged with 5600 g of distilled water containing 50 g of oxidized gelatin containing <4 μmole methionine per gram gelatin, 2 grams of xanthine, 2.5 g of NaCl and 1 mL of an antifoamant. The pH was adjusted to 7.0 at 80° C. and maintained at that value throughout the precipitation by additions of NaOH or $HNO_3$. A 4M $AgNO_3$ solution was added over a period of 2.5 min at a rate consuming 1.0% of the total Ag used. The flow was stopped for 40 min and followed by addition of 120 g of 4M NaCl solution. Then 4M $AgNO_3$ and 4M NaCl solutions were added simultaneously with linearly accelerated addition rates over a period of 40 minutes (5X from start to finish) during which time the remaining 99% of silver was consumed. The pAg of the emulsion was maintained at 6.28 during the last 40 minutes of the precipitation. The total silver precipitated was 3.88 moles. The results are presented in Table I.

EXAMPLE 3

AgCl High Aspect Ratio Tabular Grain Emulsions Precipitated at pH 5.3

The precipitation conditions of this example were the same as those of Example 2, except that 5 g of xanthine was used, the reaction vessel was maintained at pH 5.3 and at 75° C., the pAg during growth was maintained at 6.61, and the total silver precipitated was 4.11 moles. The results are summarized in Table I.

EXAMPLE 4

AgCl High Aspect Ratio Tabular Grain Emulsions Precipitated at pH 6.0 and 40° C.

The precipitation conditions of this example were the same as those of Example 2, except that 5 g of xanthine were used, the reaction vessel was maintained at pH 6.0 and at 40° C., and the pAg during growth was maintained at 7.74. The results are presented in Table I.

EXAMPLE 5

AgBrCl (≈10 Mole% Br) High Aspect Ratio Tabular Grain Emulsions

EXAMPLE 5A (10.2 M% Br)

To a stirred reaction vessel containing 300 mL of a solution at 75° C. that was 2.7% in bone gelatin, 0.040 M in NaCl, 2.7 mM in NaBr and 2.7 M in sodium acetate were added 100 mL of a 12 mM basic xanthine solution. The pH of the resulting solution was adjusted to 6.2. A solution 4 M in $AgNO_3$, a salt solution 3.6 M in NaCl, and 0.4 M in NaBr were added to the reaction vessel at 75° C. The $AgNO_3$ solution was added at 0.25 mL/min for 1 min then its flow rate was accelerated at 0.158 mL/min/min until 0.27 mole of $AgNO_3$ was added, requiring a total of 29 min. The salt solution was added at a similar rate, but as needed to maintain a constant pAg of 6.65. When the pH dropped 0.2 units below the starting value of 6.2, the flow of solutions was momentarily stopped, and the pH was adjusted back to the starting value. The results are presented in Table I.

EXAMPLE 5B (10.8 Mole% Br)

This emulsion was prepared similar to that of Example 5A, except that the precipitation was stopped after 0.13 mole of $AgNO_3$ had been added. The results are summarized in Table I.

CONTROL 6

Attempt to use Uric Acid to form High Aspect Ratio AgCl Tabular Grain Emulsions

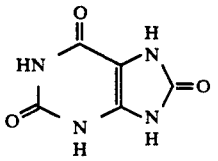

Uric Acid

CONTROL 6A (pH 6.2)

This emulsion was prepared similar to that of Example 1A, except that 100 mL of a 12 mM basic uric acid solution was added to the reaction vessel in place of the xanthine solution. A nontabular grain emulsion resulted.

CONTROL 6B (pH 4.5)

This emulsion was prepared similar to that of Control 6A, except that the pH was maintained at 4.5. A nontabular grain emulsion resulted.

CONTROL 7

Attempt to use Guanine to form a High Aspect Ratio AgCl Tabular Grain Emulsion

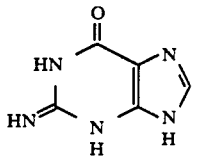

Guanine

This emulsion was prepared similar to that of Example 1A, except that 100 mL of a 12 mM acidic guanine solution was added to the reaction vessel in place of the xanthine solution. A nontabular grain emulsion resulted.

CONTROL 8

Attempt to use Hypoxanthine to form a High Aspect Ratio AgCl Tabular Grain Emulsion

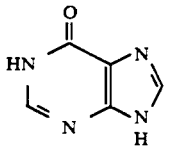

Hypoxanthine

The emulsion was prepared similar to that of Example 1A, except that the xanthine solution was replaced with 100 mL of a 12 mM basic hypoxanthine solution. A nontabular grain emulsion resulted.

TABLE I

| Example | pH | Temp (°C.) | $AgNO_3$ added (mole) | Final GGM per Ag (mmole/mole) | Projected area as fine grains * (%) | Tabular Grain Population: Mean ECD (μm) | Mean t (μm) | Mean Aspect ratio | % TPGA |
|---|---|---|---|---|---|---|---|---|---|
| 1A | 6.2 | 75 | 0.40 | 3.0 | 2 | 2.87 | 0.170 | 16.9 | 85 |
| 1B | 6.2 | 75 | 0.27 | 4.4 | 10 | 2.40 | 0.125 | 19.2 | 80 |
| 1C | 6.2 | 75 | 0.13 | 9.2 | 20 | 2.07 | 0.093 | 22.3 | 70 |
| 2 | 7.0 | 80 | 3.90 | 3.4 | 0 | 3.20 | 0.15 | 21.3 | 85 |
| 3 | 5.3 | 75 | 4.10 | 8.0 | 10 | 2.30 | 0.25 | 9.2 | 85 |
| 4 | 6.0 | 40 | 3.90 | 8.5 | 10 | 1.10 | 0.087 | 12.6 | 90 |
| 5A | 6.0 | 75 | 0.27 | 4.4 | 10 | 2.40 | 0.120 | 20.0 | 85 |
| 5B | 6.0 | 75 | 0.13 | 9.2 | 20 | 1.83 | 0.091 | 20.1 | 75 |

* ECD < 0.2 μm
5A = 10.2 mole % AgBr;
5B = 10.6 mole % AgBr

The invention has been described in detail with particular reference to preferred embodiments thereof, but it will be understood that variations and modifications can be effected within the spirit and scope of the invention.

We claim:

1. A process of preparing a radiation sensitive high aspect ratio tabular grain emulsion, wherein tabular grains of less than 0.3 μm in thickness and an average aspect ratio of greater than 8:1 account for greater than 50 percent of the total grain projected area, said tabular grains containing at least 50 mole percent chloride, based on silver, comprising introducing silver ion into a gelatino-peptizer dispersing medium containing a stoichiometric excess of chloride ions with respect to the silver ions further characterized by a chloride ion concentration of less than 0.5 molar and a grain growth modifier of the formula:

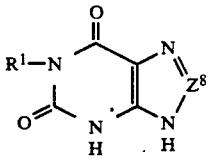

where $Z^8$ is —C($R^8$)= or —N=;

$R^8$ is H, $NH_2$ of $CH_3$; and $R^1$ is hydrogen or a hydrocarbon of from 1 to 7 carbon atoms.

2. A process according to claim 1 further characterized in that $Z^8$ is chosen to complete a xanthine nucleus.

3. A process according to claim 2 further characterized in that the grain growth modifier satisfies the formula:

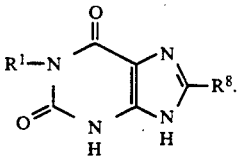

4. A process according to claim 3 further characterized in that $R^1$ and $R^8$ are each hydrogen or methyl.

5. A process according to claim 1 further characterized in that $R^1$ and $R^8$ are each hydrogen.

6. A process according to claim 1 further characterized in that $Z^8$ is chosen to complete an 8-azaxanthine.

7. A process according to claim 6 further characterized in that the 8-azaxanthine satisfies the formula:

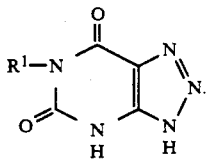

8. A process according to claim 7 further characterized in that $R^1$ is hydrogen or methyl.

9. A process according to claim 8 further characterized in that $R^1$ is hydrogen.

10. A process according to claim 1 further characterized in that the chloride ion concentration is less than 0.2 molar.

11. A process according to claim 1 further characterized in that the pH can range up to 9.

12. A process according to claim 11 further characterized in that the pH is in the range of from 4.5 to 8.

13. A process according to claim 1 further characterized in that the grain growth modifier is present in at least a $7\times10^{-4}$ molar concentration.

14. A process according to claim 1 further characterized in that the tabular grains contain less than 2 mole percent iodide, based on silver.

15. A process according to claim 1 further characterized in that the tabular grains consist essentially of silver chloride.

16. A process according to claim 1 further characterized in that the grain growth modifier is present during twin plane formation.

17. A process according to claim 1 further characterized in that the grain growth modifier is employed in combination with a second grain growth modifier chosen from the group consisting of:

(a) iodide ions;

(b) thiocyanate ions; and (c) a compound of the formula:

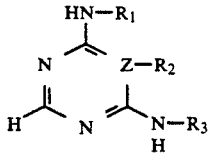

wherein Z is C or N; $R_1$, $R_2$ and $R_3$, which may be the same or different, are H or alkyl of 1 to 5 carbon atoms; Z is C, $R_2$ and $R_3$ when taken together can be $-CR_4=CR_5-$ or $-CR_4=N-$, wherein $R_4$ and $R_5$, which may be the same or different, are H or alkyl of 1 to 5 carbon atoms, with the proviso that when $R_2$ and $R_3$ taken together form the $-CR_4=N-$ linkage, $-CR_4=$ must be joined to Z.

* * * * *